United States Patent [19]

Fujii et al.

[11] Patent Number: 4,748,946

[45] Date of Patent: Jun. 7, 1988

[54] SOHC TYPE INTERNAL COMBUSTION ENGINE

[75] Inventors: Noriaki Fujii; Takeshi Iwata; Toshihiro Oikawa, all of Wako, Japan

[73] Assignee: Honda Giken Kogyo Kabushiki Kaisha, Tokyo, Japan

[21] Appl. No.: 70,987

[22] Filed: Jul. 8, 1987

[30] Foreign Application Priority Data

Jul. 9, 1986 [JP] Japan ..... 61-161480

[51] Int. Cl.[4] ..... F02P 13/00; F01L 1/26

[52] U.S. Cl. ..... 123/90.44; 123/90.27; 123/90.6; 123/193 H; 123/169 PH

[58] Field of Search ..... 123/90.44, 90.27, 90.6, 123/193 H, 193 CH, 169 P, 169 PH

[56] References Cited

U.S. PATENT DOCUMENTS

| | | | |
|---|---|---|---|
| 2,686,511 | 8/1954 | Platner | 123/169 PH |
| 4,267,811 | 5/1981 | Springer | 123/90.27 |
| 4,553,515 | 11/1985 | King et al. | 123/90.27 |
| 4,561,391 | 4/1985 | Simko | 123/90.27 |
| 4,592,314 | 4/1985 | Tsuchida | 123/90.36 |
| 4,612,885 | 9/1986 | Yoshikawa | 123/90.27 |
| 4,617,881 | 10/1986 | Aoi et al. | 123/90.44 |
| 4,621,597 | 11/1986 | Kawada et al. | 123/90.44 |
| 4,637,358 | 1/1987 | Yano et al. | 123/169 PH |
| 4,660,527 | 4/1987 | Tanaka et al. | 123/193 H |
| 4,660,529 | 4/1987 | Yoshikawa | 123/90.27 |
| 4,662,323 | 5/1987 | Moriya | 123/90.27 |
| 4,671,222 | 6/1987 | Gallot et al. | 123/90.27 |

FOREIGN PATENT DOCUMENTS

| | | |
|---|---|---|
| 2739132 | 3/1979 | Fed. Rep. of Germany . |
| 55-151104 | 11/1980 | Japan . |
| 56-143322 | 11/1981 | Japan . |
| 60-209612 | 10/1985 | Japan . |
| 61-152706 | 9/1986 | Japan . |
| 11521805 | 8/1967 | United Kingdom . |
| 1331226 | 11/1969 | United Kingdom . |
| 2121476 | 5/1983 | United Kingdom . |
| 2142975 | 7/1984 | United Kingdom . |
| 2159877 | 5/1985 | United Kingdom . |

*Primary Examiner*—Ira S. Lazarus

*Attorney, Agent, or Firm*—Armstrong, Nikaido, Marmelstein & Kubovcik

[57] ABSTRACT

An SOHC type internal combustion engine having a cam shaft for opening and closing intake and exhaust valves via rocker arms, the cam shaft being held between a cam shaft receiving wall of a cylinder head and a cam shaft holder which is secured to the cam shaft receiving wall, wherein a hole for allowing insertion of an ignition plug into a plug mounting hole is formed in the cam shaft receiving wall and opens to the surface of the wall against which a cam shaft holder abuts, and a hole for guiding a high power cord for an ignition plug is formed between the mutually abutting surfaces of the cam shaft receiving wall and the cam shaft holder.

2 Claims, 4 Drawing Sheets

SOHC TYPE INTERNAL COMBUSTION ENGINE

BACKGROUND OF THE INVENTION

1. Field of the Invention

This invention relates to an SOHC type internal combustion engine, and particularly to an improvement in an SOHC type internal combustion engine in which an ignition plug mounting hole which opens to a center portion of the top surface of the combustion chamber in the cylinder head and an ignition plug insertion hole communicated to the ignition plug mounting hole are provided, a cam shaft is held between a cam shaft receiving wall of a cylinder head and a cam shaft holder which is secured to the cam shaft receiving wall, and rocker arms which move in operative connection between the cam shaft and an intake valve and between the cam shaft and an exhaust valve are journaled to the cam shaft holder.

2. Description of the Prior Art

In such conventional internal combustion engine, a cylinder portion having the ignition plug insertion hole is formed integrally with or separately from the cylinder head, and the outer end of the cylinder portion is supported by a head cover so as to arrange an outlet of the insertion hole for a plug high power cord located on the exterior surface of the head cover. (For example: Japanese Utility Model Publication Kokai No. 87308/85)

However, in order to prevent interference of the cylinder portion with the rocker arms and a rocker arm shaft, the rocker arm and rocker arm shaft are required to have a special structure. A valve actuating system, therefore, becomes very expensive. The degree of freedom in design of the valve actuating system is limited because the positions of the above parts is restricted.

SUMMARY OF THE INVENTION

An object of the present invention is to provide an internal combustion engine which can overcome the above problems.

This invention is characterized in that the plug insertion hole is formed in the cam shaft receiving wall so as to open to its cam shaft abutting surface, and a hole for passing the high power code of the ignition plug which is secured into the above ignition plug mounting hole is provided between the cam shaft holder abutting surface of said cam shaft receiving wall and the cam shaft receiving wall abutting surface of the cam shaft holder, these two surfaces being abutted each other.

Owing to the arrangement as mentioned above, there is no necessity of forming the rocker arm and the rocker arm shaft into a special structure because the cam shaft receiving wall provided with an ignition plug insertion hole does not interfere with the rocker arm and the rocker arm shaft. As a result, cost required for the valve actuating system can be kept low. Furthermore, the degree of freedom in design of the valve actuating system can be kept large because a wide space is secured on the cam shaft holder side of the cam shaft receiving wall.

BRIEF DESCRIPTION OF THE DRAWINGS

The accompanying drawings illustrate one embodiment of the present invention, in which.

PREFERRED EMBODIMENT OF THE INVENTION

Figure 1:
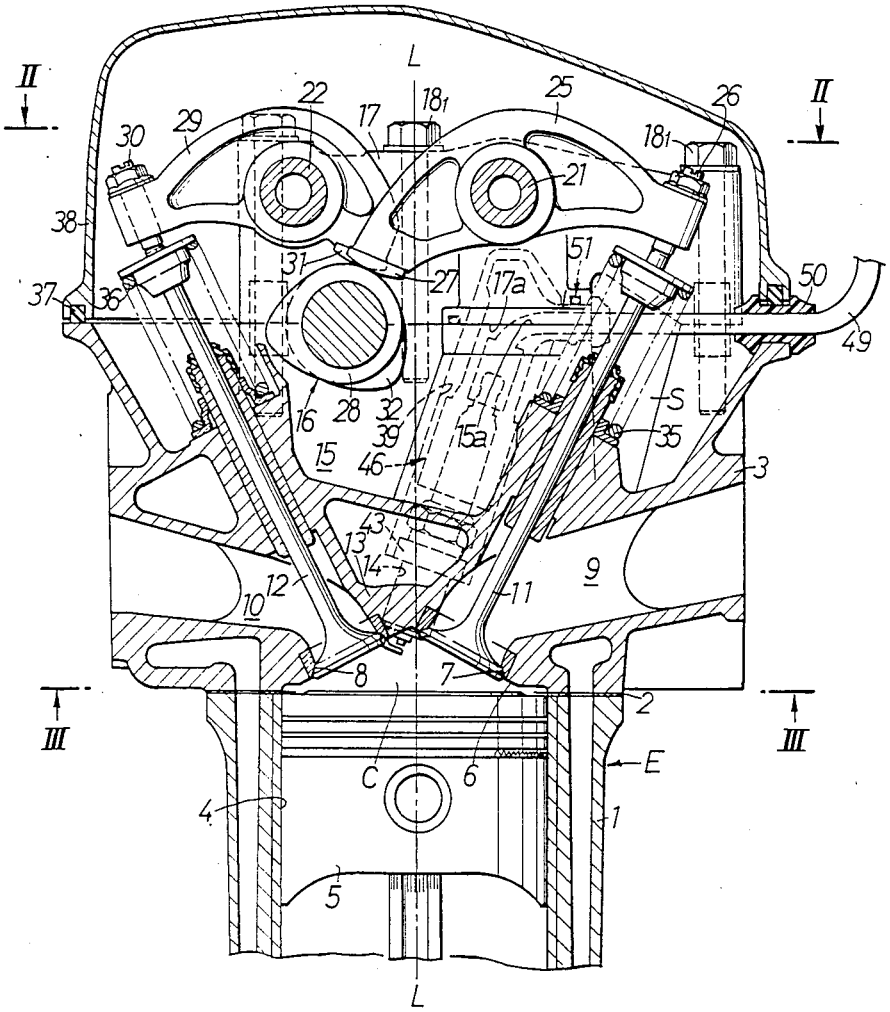
FIG. 1 is a vertical cross sectional front view.
Figure 2:
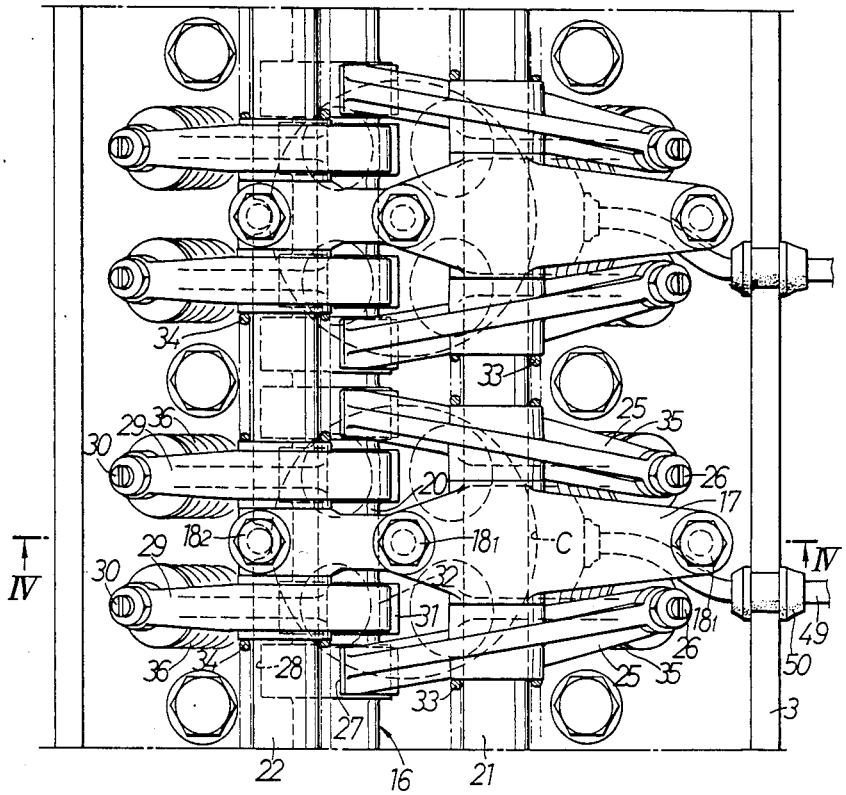
FIG. 2 is a cross sectional view taken along the line II—II in FIG. 1.
Figure 3:
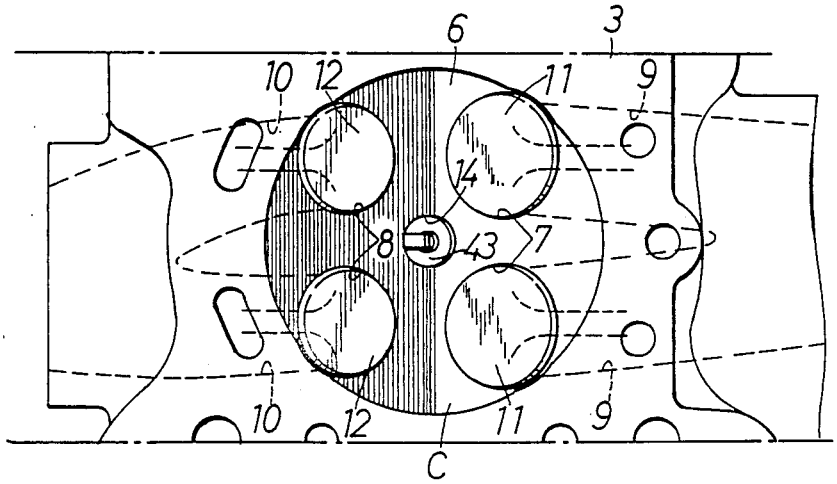
FIG. 3 is a view taken along the line III—III in FIG. 1.

Accompanying drawings illustrate an SOHC type four-valve multi-cylinder internal combustion engine in which an engine body E, shown in FIGS. 1 and 2, comprises a cylinder block 1 and a cylinder head 3 which is superposed and secured onto the cylinder block 1 with a gasket 2 therebetween. A piston 5 is slidably fitted into a cylinder bore 4 in the cylinder block 1. A combustion chamber C is formed in the cylinder head 3 in such a manner that the chamber faces a head surface of the piston 5. The top surface 6 of this combustion chamber is formed into a roof shape in which two surfaces are arranged facing each other at an angle. Two intake valve openings 7 of same diameter, as can clearly be seen in FIG. 3, open in parallel to one of the slanting surfaces of the top surface 6 of the combustion chamber. Two exhaust valve openings 8 having a diameter slightly smaller than that of the intake valve openings 7 open in parallel to the other slanting surface. The intake valve openings 7 oppose the exhaust valve openings 8.

Intake ports 9 formed in the cylinder head 3 are connected to the intake valve openings 7 and merge together within the cylinder head 3, and the combined part thereof opens in one side surface of the cylinder head 3, then is connected to a fuel supply device, such as a carburetor, through an intake manifold, omitted from the illustration. The exhaust valve openings 8 are communicated to exhaust valve ports 10 which are formed in the cylinder head 3, and the exhaust valve openings 10 are merged together within the cylinder head 3, open in the other side of the cylinder head 3, then leading to an exhaust system through an exhaust manifold, omitted from the illustration.

A pair of intake valves 11 which act to open and close the intake valve openings 7 and a pair of exhaust valves 12 which act to open and close the exahust valve openings 8 are slidably supported by the cylinder head 3. The intake valves 11 and the exhaust valves 12 are arranged at an angle on each side of the center line L—L of the cylinder bore 4 in such a manner that their stem ends are far away from each other.

An ignition plug mounting hole 14 opens to the center portion of the top surface 6 of the combustion chamber and is formed in a mounting hole forming portion of the cylinder head 3.

Cam shaft receiving walls 15 are each provided continuously with the ignition plug mounting hole 13 at a position between two adjacent intake valves 11 and two ajacent exhaust valves 12. Cam shaft holders 17 which rotatably hold the cam shaft 16 in coorpration with the cam shaft receiving walls 15 are abutted against the cam shaft receiving walls and are secured thereto by means of a plurality of bolts $18_1$. Cam shaft holder abutting surfaces 15*a* of the cam shaft receiving walls 15 and cam shaft receiving wall abutting surfaces 17*a* of the cam shaft holders 17 are provided with semicircular bearing recesses $19_1$ and $19_2$ which are positioned offset toward the exhaust valve 12 side from the center line L—L of the cylinder bore 4 in such a manner that the recesses face each other. And cam shaft journals 20 of the cam shaft 16 are received in between the recesses $19_1$ and $19_2$. The cam shaft 16 is, as in the conventional manner, driven and rotated in operative connection with the crank shaft via a timing transmission device.

An intake rocker arm shaft 21 and an exhaust rocker arm shaft 22 are respectively provided in parallel to the cam shaft 16 at a position between the intake valves 11 and the cam shaft 16 and at a position between the exhaust valves 12 and the cam shaft 16. The both rocker arm shafts 21 and 22 are inserted into bearing holes 23 and 24 provided in the cam shaft holder 17 with anti-rotation means given thereto. Reference numeral $18_2$ shows an anti-rotation bolt for the exhaust rocker arm shaft 22.

Two intake rocker arms 25 per cylinder are swingably supported by the intake rocker arm shaft 21 for operative connection between the cam shaft 16 and the intake valves 11. Outer ends of these rocker arms 25 are abutted against the end surfaces of the stems of the intake valves 11 through adjusters 26. Slipper portions 27 located at the internal ends of these rocker arms 25 are respectively abutted against intake cams 28 on the cam shaft 16. Two exhaust rocker arms 29 per cylinder are swingably supported by the exhaust rocker arm shaft 22 for operative connection between the cam shaft 16 and the exhaust valves 12. Outer ends of these rocker arms 29 are respectively abutted against the end surfaces of the stems of the exhaust valves 12 through adjusters 30. Slipper portions 31 positioned at the internal ends are abutted against exhaust cams 32 on the cam shaft 16, respectively.

In these two rocker arm shafts 21 and 22, as shown in FIG. 2, compression springs 33 and 34 are interposed between the side walls of the cylinder head 3 and the rocker arms 25 and 29 and between adjacent rocker arms 25 and 29 for the purpose of urging rocker arms 25 and 29 toward the cam shaft receiving walls 15 and preventing axial movement of rocker arms 25 and 29.

The intake rocker arms 25 and the exhaust rocker arms 29 are swung around the rocker arm shafts 21 and 22, respectively, when the cam shaft 16 rotates, and open and close the intake valves 11 and exhaust valves 12 in cooperation with valve springs 35 and 36.

Figure 4:
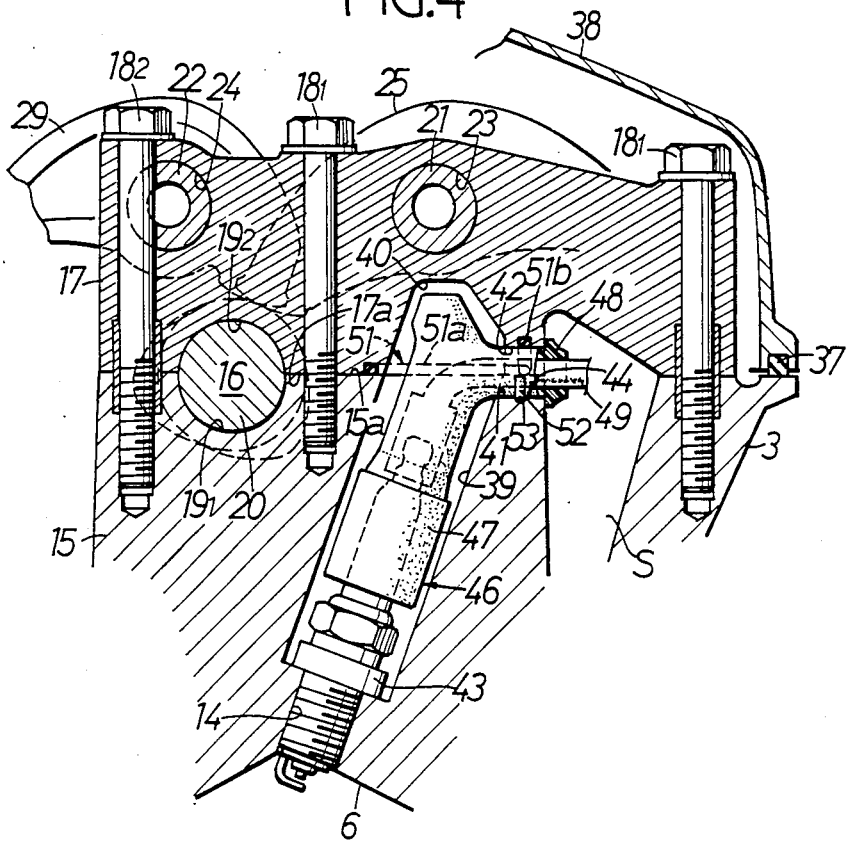
FIG. 4 is a cross sectional view taken along the line IV—IV in FIG. 2.

A head cover 38 is secured to the opening portion in the cylinder head 3 via a sealing packing 37 therebetween. As shown in FIGS. 1 and 4, in the cam shaft receiving walls 15, there are formed ignition plug insertion holes 39 which open to the cam shaft holder abutting surfaces 15*a* and are offset from the center line L—L of the cylinder bore 4 toward the intake valves 11. Each ignition plug insertion hole 39 is arranged aligned with the ignition plug mounting hole 14 and connected thereto. Recess portion 40 which opens toward the ignition plug insertion hole 39 is formed in each cam shaft holder 17. A pair of grooves 41 and 42 in the form of a semicircular cross sectional shape are formed in the cam shaft holder abutting surface 15*a* of cam shaft receiving wall 15 and in the cam shaft receiving wall abutting surface 17*a* of cam shaft holder 17. The pair of grooves 41 and 42 form a hole 44 for guiding a high power cord 49 for the ignition plug 43 to the outside. The internal end of the guide hole 44 is connected to the ignition plug insertion hole 39, and its exterior end opens to the internal surface of a space S which is defined by the intermediate portions of the cam shaft receiving wall 15 and the cam shaft holder 17.

The ignition plug 43 is inserted into the ignition plug insertion hole 39 and is mounted to the ignition plug mounting hole 14. Since the ignition plug 43 is provided in the center portion of the top surface 6 of the combustion chamber as mentioned above, the distance of flame propagation from the ignition point to each peripheral end of the combustion chamber C can be designed substantially same and the time required for combustion can be minimized, as a result of which high power can be output.

Figure 5:
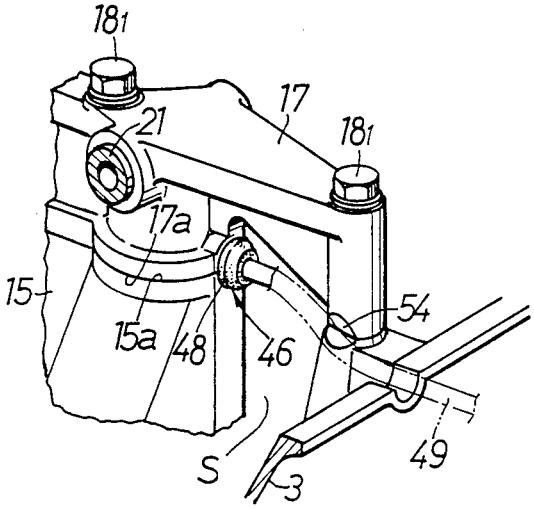
FIG. 5 is a perspective view of the portion in which a high power cord for the ignition plug is taken out.

A synthetic resin made plug cap 46 comprises a mounting cylinder portion 47 which is secured to the ignition plug 43 and a guide cylinder portion 48 which is projectingly provided on the external surface of the mounting cylinder portion 47 and is arranged to guide the high power code 49 which is connected to the ignition plug 43. The mounting cylinder portion 47 is accommodated in the ignition plug insertion hole 39 and in the recess 40. The guide cylinder portion 48 penetrates the guiding hole 44. As shown in FIG. 5, the high power cord 49 is arranged to be guided by a notch 54 which is formed at the outside surfaces of the cam shaft receiving wall 15 and the cam shaft holder 17 near their abutting surfaces 15*a* and 17*a*, then passes a grommet 50 which is held between the cylinder head 3 and the head cover 38 so as to extend outside of the cylinder head 3.

Due to this passing arrangement of the high power cord 49 through between the cam shaft receiving wall 15 and the cam shaft holder 17, the cam shaft receiving wall 15 having the ignition plug insertion hole 39 does not interfere with both rocker arm shafts 21 and 22 which are supported on the cam shaft holder 17 and the rocker arms 25 and 29, and therefore, normal type of rocker arm shaft and rocker arm can be used as the both rocker arm shafts 21 and 22 and the rocker arms 25 and 29. The degree of freedom in design of the valve actuating device including the rocker arms 21 and 22 can be increased because a wide space is provided on the cam shaft holder 17 side of the cam shaft receiving wall 15.

The ignition plug insertion hole 39 is sealed its surroundings by an almost circular main body portion 51*a* of a seal ring 51. And a circumferential half of the guide cylinder 48 on the side of the cam shaft holder 17 is sealed by a semicircular portion 51*b* of the seal ring 51 connected to separate ends of the main body portion 51*a*. The remaining circumferential half of the guide cylinder 48 on the side of the cam shaft receiving wall 15 is sealed by fitting a semicircular locating projection 52, which is integrally formed on the guide cylinder 48, into a semicircular small groove 53 formed in the internal surface of the groove 41 on the cam shaft receiving wall 15.

What is claimed is:

1. An SOHC type internal combustion engine comprising a cylinder head, a combustion chamber in the cylinder head, an ignition plug, an intake valve, an exhaust valve, a cam shaft on the cylinder head between a cam shaft receiving wall and a cam shaft holder secured to said wall, and a rocker arm operatively connecting said cam shaft and said intake and exhaust valves and pivoted to said cam shaft holder, wherein said cam shaft receiving wall has a cam holder abutting surface and said cam shaft holder has a cam shaft receiving wall abutting surface mating with said cam shaft holder abutting surface, in the cylinder head are provided an ignition plug mounting hole opening to a center portion of a ceiling wall of the combustion chamber and an ignition plug insertion hole communicating with said plug mounting hole, said ignition plug insertion hole being in said cam shaft receiving wall and having an opening at said cam shaft holder abutting surface, a guiding hole being formed between said cam shaft holder abutting surface and said cam shaft receiving wall abutting surface, said guiding hole guiding a high power cord for said ignition plug mounted to said plug mounting hole to outside.

2. An SOHC type internal combustion engine according to claim 1, further comprising a cylinder block having a cylinder bore therein, said cam shaft being offset toward one of opposite sides of a center line of said cylinder bore, and said ignition plug mounting hole being arranged inclining toward the other side of said center line of the cylinder bore.

* * * * *